US007238118B1

(12) United States Patent
Terrill

(10) Patent No.: US 7,238,118 B1
(45) Date of Patent: Jul. 3, 2007

(54) FOLDABLE GOLF SWING TRAINING AID FOR USE BY A RIGHT-HANDED GOLFER AND A LEFT-HANDED GOLFER

(76) Inventor: Timothy T. Terrill, 32 Fox Pl., Hicksville, NY (US) 11801

( * ) Notice: Subject to any disclaimer, the term of this patent is extended or adjusted under 35 U.S.C. 154(b) by 0 days.

(21) Appl. No.: 11/171,787

(22) Filed: Jun. 30, 2005

(51) Int. Cl.
*A63B 69/36* (2006.01)

(52) U.S. Cl. ..... 473/272; 266/268

(58) Field of Classification Search ..... 473/261, 473/263, 265, 266, 268, 257–264, 271–277, 473/452

See application file for complete search history.

(56) References Cited

U.S. PATENT DOCUMENTS

| | | | | |
|---|---|---|---|---|
| 3,244,421 | A | 4/1966 | Hanna | |
| 3,561,764 | A | 2/1971 | Thomas | |
| 3,860,247 | A | 1/1975 | Taylor | |
| 3,934,882 | A | 1/1976 | Whittaker | |
| 4,544,160 | A | 10/1985 | Miner | |
| 4,647,048 | A | 3/1987 | Welch | |
| 4,784,393 | A * | 11/1988 | Williams et al. | 473/272 |
| 5,083,789 | A | 1/1992 | Hickson | |
| D338,940 | S | 8/1993 | Pellington | |
| 5,322,288 | A * | 6/1994 | Amis | 473/272 |
| 5,350,177 | A | 9/1994 | Furbush, Jr. | |
| 5,362,060 | A * | 11/1994 | Hinson | 473/218 |
| 5,893,805 | A * | 4/1999 | Douglass | 473/218 |
| 6,106,408 | A * | 8/2000 | Roman | 473/266 |
| 6,723,003 | B1 * | 4/2004 | Harrell | 473/270 |
| 6,945,875 | B2 * | 9/2005 | Gauer | 473/270 |

* cited by examiner

*Primary Examiner*—Nini F. Legesse
(74) *Attorney, Agent, or Firm*—Richard L. Miller

(57) ABSTRACT

A foldable golf swing training aid for use by a right-handed golfer and a left-handed golfer. A base receives a golf tee and includes a pair of members pivotally attached to each other so as to allow the base to be foldable. A pair of arms are pivotally attached to ends of the base, respectively, so as to allow the pair of arms to be foldabe. The pair of arms extend perpendicularly to the base in opposite directions to each other when in a use position, and overly associated base members when in the stored position. Indicia aids in positioning the base and the pair of arms relative to the right-handed golfer and the left-handed golfer, and corresponds to numbers of a clock including one, five, six, seven, and eleven.

15 Claims, 3 Drawing Sheets

FIG. 2
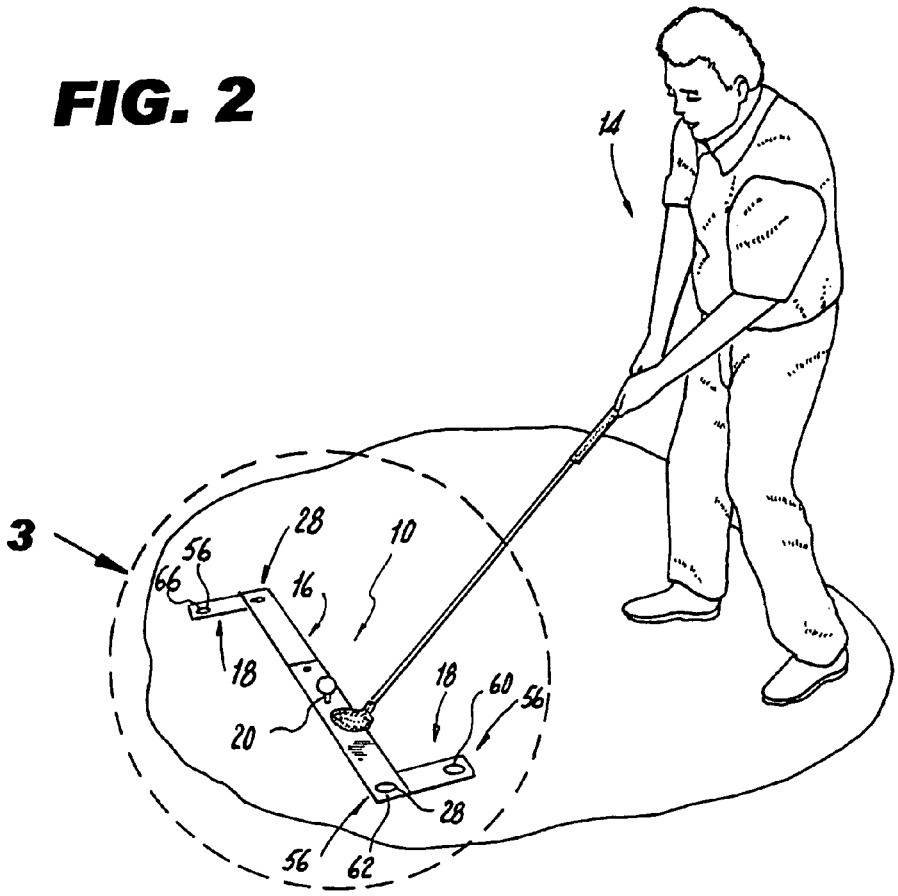
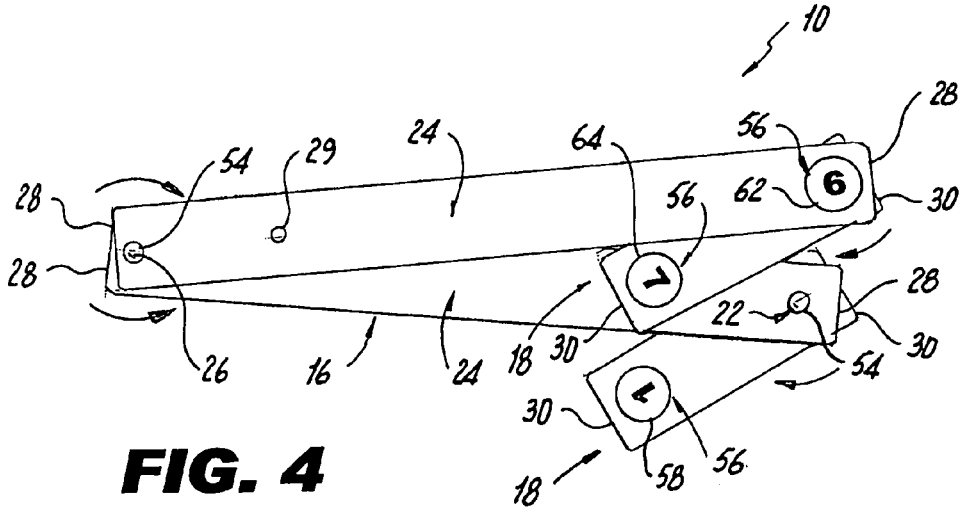
FIG. 4

FOLDABLE GOLF SWING TRAINING AID FOR USE BY A RIGHT-HANDED GOLFER AND A LEFT-HANDED GOLFER

BACKGROUND OF THE INVENTION

1. Field of the Invention

The present invention relates to a golf training aid, and more particularly, the present invention relates to a foldable golf swing training aid for use by a right-handed golfer and a left-handed golfer.

2. Description of the Prior Art

Numerous innovations for golf swing training aids have been provided in the prior art that will be described. Even though these innovations may be suitable for the specific individual purposes to which they address, however, they differ from the present invention.

A FIRST EXAMPLE, U.S. Pat. No. 3,244,421 to Hanna teaches a golf stance corrector consisting of a first front foot plate, a first elongated member rigidly fixed to and projecting laterally from the foot plate, a second elongated member telescopically associated with the first elongated member and being longitudinally adjustable relative thereto, means for releasably fixing the second member to the first member in a plurality of longitudinally adjusted positions, a second rear foot plate, and laterally adjustable mounting means releasably fixing the second foot plate to the outer end of the second elongated member at any one of a plurality of laterally spaced positions relative to the outer end.

A SECOND EXAMPLE, U.S. Pat. No. 3,561,764 to Thomas teaches a panel structure for positioning on the ground in a golf tee area and defining a pair of generally straight visually ascertainable paths inclined approximately 20 to 30 degrees relative to each other and intersecting at one pair of corresponding ends, the panel structure being operative, when a ball is teed up on a first of the paths at a point spaced therealong from the intersecting ends of the paths and the nonintersecing end portion of the first path extends in the intended tee shot direction, to provide a visual guide defined by the second path to assist the golfer in swinging "out and through" when swinging at the teed ball.

A THIRD EXAMPLE, U.S. Pat. No. 3,860,247 to Taylor teaches a golf ball spotting, putter guiding and back-stroke determining aid for practice use indoors on a carpeting surface or outdoors on a putting green characterized by a pair of structurally unique coplanar flat-faced guide members having confronting spaced parallel straight edges. Assembling and coordinating strap or equivalent means is detachably and adjustably connected to marginal edges of the respective guide members in a manner to define and maintain an open-ended channel-like guideway between the companion straight edges. This guideway is bordered by suitably calibrated ball and putter positioning scales which, in conjunction with an adjustable limit stop abutment, enables the user to better acquire, generally stated, the knowledge and fine points required to determine the back-stroke needed and to thus cause the captive ball to travel a predetermined distance. One guide member is such in construction that the user can retain his basic putting stance and the relationship between the ball and its spotted locale relative to his established lead foot. Specifically, a U-shaped cutout or recess is provided in the one guide member to permit the user's shoes to be properly positioned relative to the ball to be putted. A limit stop member is detachably mounted on either of spaced, parallel planar surfaces of the guide members for providing a gauge to further aid the putter. By permitting attachment of the limit stop member to either of these planar surfaces, the aid can be adapted for either left-handed or right-handed golfers. Advantageously, a plurality of sockets are provided in the guide members for receiving pins provided on the limit stop member to achieve the aforementioned selective mounting of the limit stop member.

A FOURTH EXAMPLE, U.S. Pat. No. 3,934,882 to Whittaker teaches a thin, flat member longer than its width has parallel sides and one end formed at a right angle thereto and notched midway between the sides, the other opposite end being pointed. A visible line is formed on the longitudinal axis and extends from the mid portion of the notch on the one end to the apex of the pointed end. The upper surface of the thin flat member is preferably reflective material which enables a golfer to see whether or not his head is over the ball and improves the golfer's view of club head movement after striking the ball. The notch forms a location for a golf ball. The flat member may be creased along its longitudinal axis to facilitate folding. In use the golf guide forms a visual path for the golf club after the golf ball is hit together with a transverse plane of reference for alignment with the head of a golf club when the golf ball is hit.

A FIFTH EXAMPLE, U.S. Pat. No. 4,544,160 to Miner teaches a golf putting practice device that includes a pair of elongated rigid strips that are held spaced apart and parallel by a transverse bar to define between their inner longitudinal edges a putter stroke area. A pair of plate members are moveable along each of the rigid strips and include lock elements to fix them at positions along the rigid strips selected by use of measurement indicia on the upper surfaces of the rigid strips. The transverse bar is adjustable to vary the spacing between the parallel strip and a further bar is secured to one of the moveable plate members and extends away from the strips to provide a foot location guide.

A SIXTH EXAMPLE, U.S. Pat. No. 4,647,048 to Welch teaches a device for setting a player's stance for the game of golf having an elongated base with two elongated arms extending outwardly from one end of the base. Each arm is pivotally attached to the base and is constructed from two telescoping sections so that the length of each arm is adjustable. A pair of stops are adjustably attached to the base and limit the pivotal movement of the arms while a spring urges the arms against the stops. A foot guide is secured to the free end of each arm and the foot guides are adapted to receive the player's feet. With the player's feet positioned in the foot guides and the other end of the base positioned adjacent a golf ball, the player's stance is set for the golf shot.

A SEVENTH EXAMPLE, U.S. Pat. No. 5,083,789 to Hickson teaches a teaching and practice device for improving a golfer's swing and alignment that eliminates sway. An extensible base adapted to be placed upon the playing surface is adjusted to the desired playing width and positioned substantially parallel with the desired target line. The base comprises a pair of axially displaceable brackets that can be moved with respect to each other to dispose the base at a desired length, normally the width of the golfer's shoulders. Each of the base brackets comprises a horizontal portion for contacting the playing surface and an integral vertical portion. The vertical portions comprise elongated slots adapted to be registered with one another to facilitate length adjustments. Foot control arms pivotally associated with the base at its opposite ends firmly contact the outside edges of the golfer's feet and prevent improper leg movement during the golf swing. The arms are disposed in either a folded position, in which they project towards each other and slidably contact the base, or a deployed position in which they angularly project away from the base. The first arm normally assumes an obtuse angle with respect to the base when deployed, and the second arm normally projects at a right angle when deployed. A ball positioner projects outwardly from the base towards the ball between the arms.

AN EIGHTH EXAMPLE, U.S. Pat. No. Des. 338,940 to Pellington teaches the ornamental design for a golf swing guide.

A NINTH EXAMPLE, U.S. Pat. No. 5,350,177 to Furbush, Jr. teaches a golf club swing training apparatus that provides for several aspects of training in the game of golf with a single relatively simple device. The swing trainer is collapsible, and thus may be carried within a golf bag or the like for use by an individual golfer. The trainer may be unfolded, whereupon the two guides may be aligned with the intended ball trajectory and the guide connecting links adjusted to provide visual alignment cues to the desired trajectory. Adjustable positioning markers may be adjusted to provide assistance in the placement of the ball, the golfer's left and right foot, and the club swing arc, thus defining the proper placement and positioning for the club swing arc to properly strike the ball to drive it along the desired trajectory. A fence extends upward from each guide, so the swing trainer will be displaced if the club head is too far either side of the desired arc. The ball rests directly upon the ground or a tee rather than upon a mat, in order that the path of the ball will not be affected by contact with an artificial surface. The swing trainer may be inverted for putting practice, thus providing clearance for the putted ball to pass beneath any of the components of the swing trainer. The device may also be used to assist in squaring the stance of a golfer.

It is apparent that numerous innovations for golf swing training aid have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a foldable golf swing training aid for use by a right-handed golfer and a left-handed golfer that avoids the disadvantages of the prior art.

ANOTHER OBJECT of the present invention is to provide a foldable golf swing training aid for use by a right-handed golfer and a left-handed golfer that is simple to use.

BRIEFLY STATED, STILL ANOTHER OBJECT of the present invention is to provide a foldable golf swing training aid for use by a right-handed golfer and left-handed golfer. A base receives a golf tee and includes a pair of members pivotally attached to each other so as to allow the base to be foldable. A pair of arms are pivotally attached to ends of the base, respectively, so as to allow the pair of arms to be foldabe. The pair of arms extend perpendicularly to the base in opposite directions to each other when in a use position, and overly associated base members when in the stored position. Indicia aids in positioning the base and the pair of arms relative to the right-handed golfer and the left-handed golfer, and corresponds to numbers of a clock including one, five, six, seven, and eleven.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 2 is a diagrammatic perspective view of the foldable golf swing training aid of the present invention being used by a left-handed golfer;

FIG. 4 is an enlarged diagrammatic top plan view of the foldable golf swing training aid of the present invention shown in FIG. 3, but in a partially stored orientation.

LIST OF REFERENCE NUMERALS UTILIZED IN THE DRAWING

Figure 1:
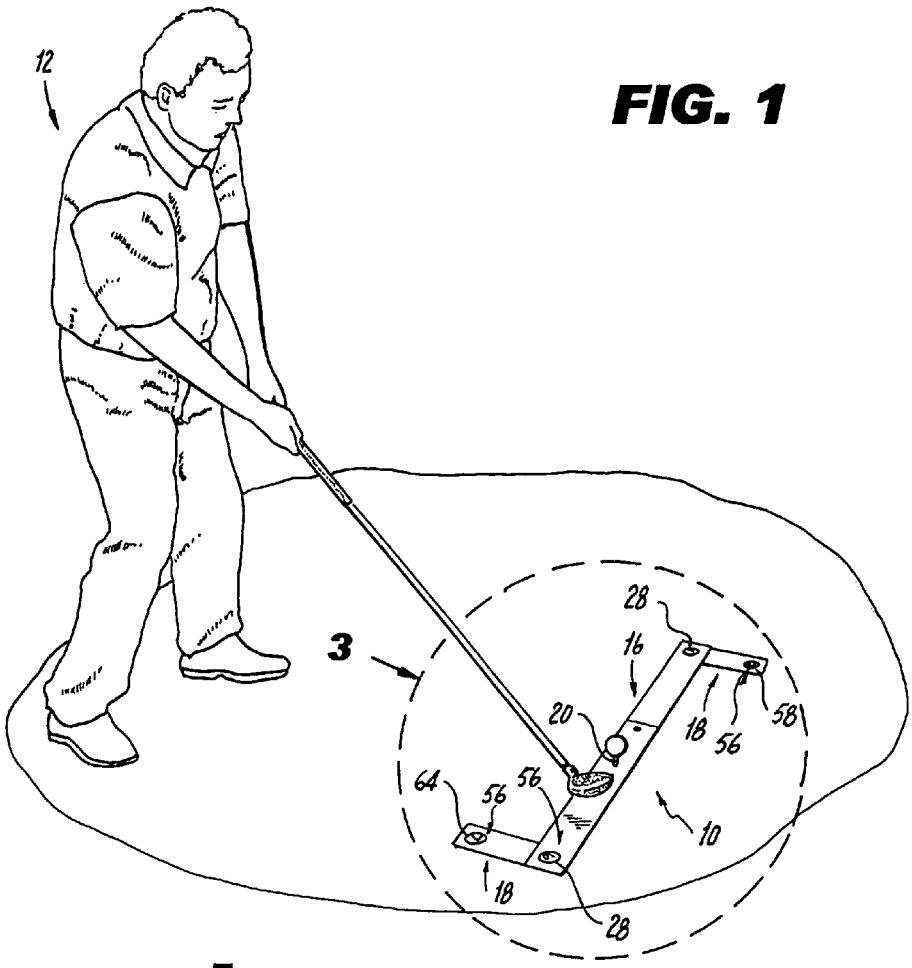
FIG. 1 is a diagrammatic perspective view of the foldable golf swing training aid of the present invention being used by a right-handed golfer.

10 foldable golf swing training aid of present invention for use by right-handed golfer 12 and left-handed golfer 14
12 right-handed golfer
14 left-handed golfer
16 base for receiving golf tee 20
18 pair of arms
20 golf tee
22 pair of first pivot joints 22
24 pair of base members of base 16
26 second pivot Joint
28 pair terminal ends of each base member of pair of base members 24 of base 16
29 tee through bore in one base member 24 of base 16
30 pair of terminal ends of each arm of pair of arms 18
32 through bore in one terminal end of pair of terminal ends 30 of the arm 18 of one first pivot joint of pair of first pivot joints 22
34 through bore in other terminal end of pair of terminal ends 28 of one base member 24 of base 16 of one first pivot joint of pair of first pivot joints 22
36 pivot rivet of one first pivot joint of pair of first pivot joints 22
38 through bore in one terminal end of pair of terminal ends 30 of other arm 18 of other first pivot joint of pair of first pivot joints 22
40 through bore in other terminal end of pair of terminal ends 28 of other base member 24 of base 16 of other first pivot joint of pair of first pivot joints 22
42 pivot rivet of other first pivot joint of pair of first pivot joints 22
44 through bore in one terminal end of pair of terminal ends 28 of one base member 24 of base 16 of second pivot joint 26
46 through bore in one terminal end 28 of other base member 24 of base 16 of second pivot joint 26
50 pivot rivet of second pivot joint 26

52 male portion of each of pivot rivet 36 of one first pivot joint of pair of first pivot joints 22, pivot rivet 42 of other first pivot joint of pair of first pivot joints 22, and pivot rivet 50 of second pivot joint 26

54 female portion of each of pivot rivet 36 of one first pivot joint of pair of first pivot joints 22, pivot rivet 42 of other first pivot joint of pair of first pivot joints 22, and pivot rivet 50 of second pivot joint 26

56 indicia for aiding in positioning base 16 and pair of arms 18 for use by right-handed golfer 12 and left-handed golfer 14

58 number one (1) of indicia 56

60 number five (5) of indicia 56

62 number six (6) of indicia 56

64 number seven (7) of indicia 56

66 number eleven (11) of indicia 56

DETAILED DESCRIPTION OF THE PREFERRED EMBODIMENT

Referring now to the figures, in which like numerals indicate like parts, and particularly to FIGS. 1 and 2, which are, respectively, a diagrammatic perspective view of the foldable golf swing training aid of the present invention being used by a right-handed golfer, and, a diagrammatic perspective view of the foldable golf swing training aid of the present invention being used by a left-handed golfer. The foldable golf swing training aid of the present invention is shown generally at 10 for use by a right-handed golfer 12 (FIG. 1) and a left-handed golfer 14 (FIG. 2).

Figure 3:
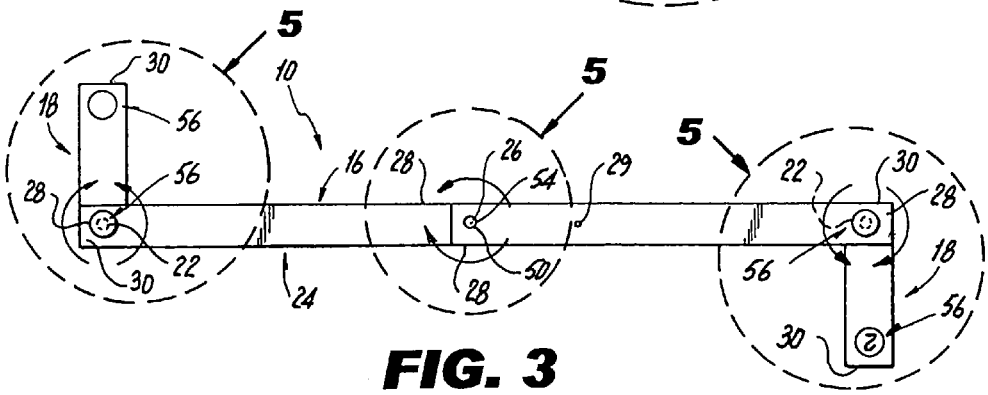
FIG. 3 is an enlarged diagrammatic top plan view of the area generally enclosed by the dotted curves identified by ARROW 3 in FIGS. 1 and 2 of the foldable golf swing training aid of the present invention in a use orientation.

The configuration of the foldable golf swing training aid 10 can best be seen in FIGS. 3 and 4, which are, respectively, an enlarged diagrammatic top plan view of the area generally enclosed by the dotted curves identified by ARROW 3 in FIGS. 1 and 2 of the foldable golf swing training aid of the present invention in a use orientation; and, an enlarged diagrammatic top plan view of the foldable golf swing training aid of the present invention shown in FIG. 3, but in a partially stored orientation, and as such, will be discussed with reference thereto.

The foldable golf swing training aid 10 comprises a base 16 and a pair of arms 18. The base 16 is for receiving a golf tee 20 (FIGS. 1 and 2), and the pair of arms 18 are pivotally attached to the base 16 by a pair of first pivot joints 22, respectively.

The base 16 comprises a pair of base members 24. The pair of base members 24 of the base 16 are pivotally attached to each other by a second pivot joint 26 so as to allow the base 16 to be foldable.

The pair of base members 24 of the base 16 are generally similar to each other, with each base member 24 of the base 16 being flat, slender, elongated, and generally rectangular-shaped.

Each base member 24 of the base 16 has a pair of terminal ends 28. One terminal end 28 of one base member 24 of the base 16 is pivotally attached to one terminal end 28 of the other base member 24 of the base 16 by the second pivot joint 26. The pair of base members 24 of the base 16 are collinear when in a use orientation (FIG. 3) and overly each other when in a stored position (FIG. 4).

The one base member 24 of the base 16 further has a tee through bore 29. The tee through bore 29 is disposed in proximity of the one terminal end 28 of the one base member 24 of the base 16.

The pair of arms 18 are generally similar to each other, with each arm 18 being flat, slender, elongated, generally rectangular-shaped, and shorter in length than one base member 24 of the base 16.

Each arm 18 has a pair of terminal ends 30. One terminal end 30 of one arm 18 is pivotally attached to the other terminal end 28 of the one base member 24 of the base 16 by one first pivot joint 22 so as to allow the one arm 18 to be foldable, with the other terminal end 30 of the one arm 18 being free, while one terminal end 30 of the other arm 18 is pivotally attached to the other terminal end 28 of the other base member 24 of the base 16 by the other first pivot joint 22 so as to allow the other arm 18 to be foldable, with the other terminal end 30 of the other arm 18 being free.

The pair of arms 18 extend perpendicularly to the base 16 in opposite directions to each other when in the use position (FIG. 3) and overly associated base members 24 of the base 16 when in the stored position (FIG. 4).

Figure 5:
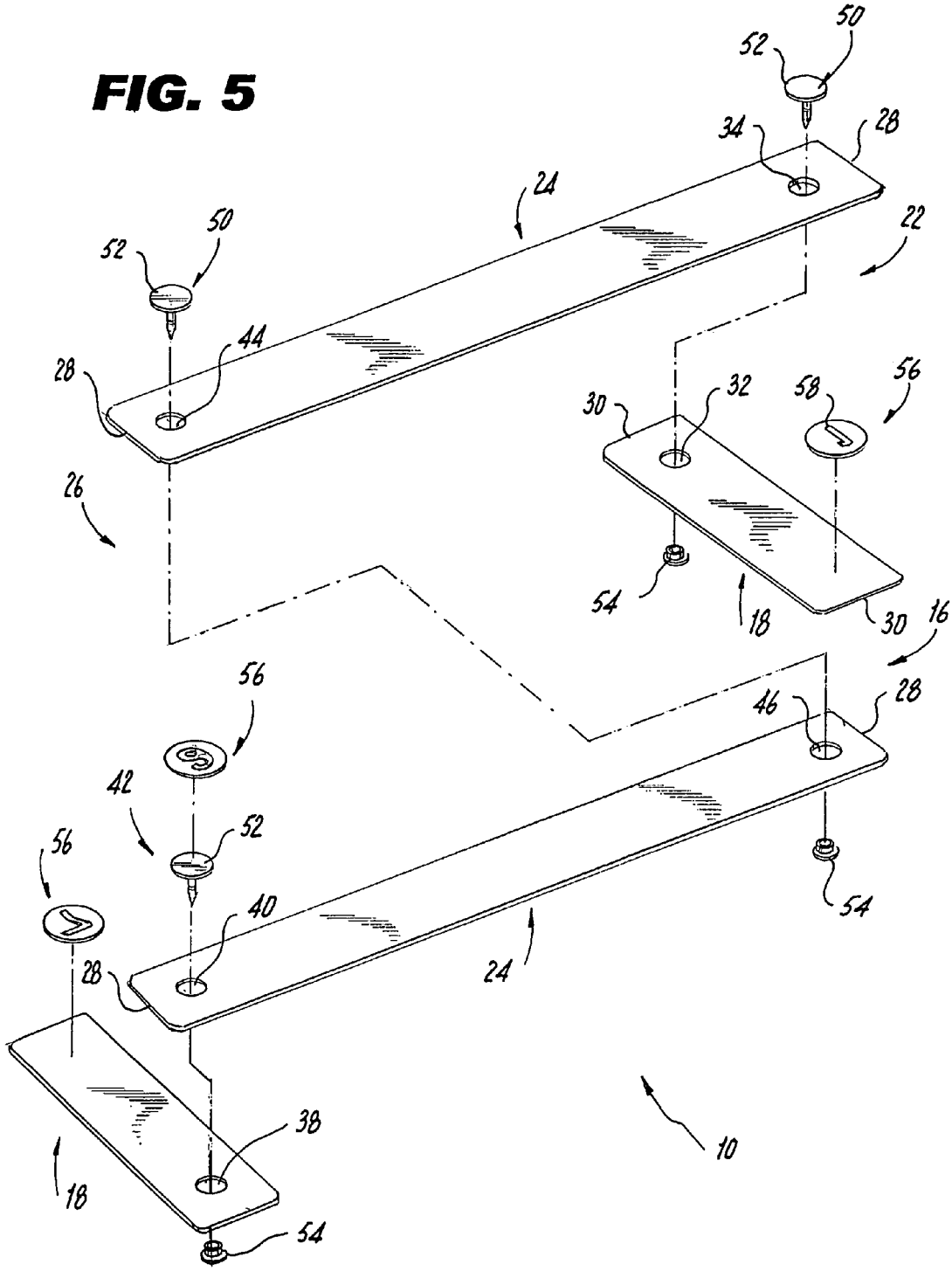
FIG. 5 is an enlarged exploded diagrammatic perspective view, with parts broken away, of the areas generally enclosed by the dotted curves identified by ARROW 5 in FIGS. 3 of the pivot joints of the foldable golf swing training aid of the present invention.

The configuration of the pair of first pivot joints 22 and the second pivot joint 26 can best be seen in FIG. 5, which is an enlarged exploded diagrammatic perspective, with parts broken away, view of the areas generally enclosed by the dotted curves identified by ARROW 5 in FIG. 3 of the pivot joints of the foldable golf swing training aid of the present invention, and as such, will be discussed with reference thereto.

One first pivot joint 22 comprises the one terminal end 30 of the one arm 18 having a through bore 32 therethrough, the other terminal end 28 of the one base member 24 of the base 16 having a through bore 34 therethrough, and a pivot rivet 36 extending through the through bore 32 in the one terminal end 30 of the one arm 18 and the through bore 34 in the other terminal end 28 of the one base member 24 of the base 16.

The other first pivot joint 22 comprises the one terminal end 30 of the other arm 18 having a through bore 38 therethrough, the other terminal end 28 of the other base member 24 of the base 16 having a through bore 40 therethrough, and a pivot rivet 42 extending through the through bore 38 in the one terminal end 30 of the other arm 18 and the through bore 40 in the other terminal end 28 of the other base member 24 of the base 16.

The second pivot joint 26 comprises the one terminal end 28 of the one base member 24 of the base 16 having a through bore 44 therethrough, the one terminal end 28 of the other base member 24 of the base 16 having a through bore 46 therethrough, and a pivot rivet 50 extending through the through bore 44 in the one terminal end 28 of the one base member 24 of the base 16 and the through bore 46 in the one terminal end 28 of the other base member 24 of the base 16.

Each of the pivot rivets 36, 42, and 50 are sold under the name "Snap Rivets" by TW FASTEX, and comprises a male portion 52 and a female portion 54 which snappingly receives the male portion 52 of an associated pivot rivet 36, 42, and 50.

As can best be seen in FIG. 4, the foldable golf swing training aid 10 further comprises indicia 56. The indicia 56 is for aiding in positioning the base 16 and the pair of arms 18 for use by the right-handed golfer 12 and the left-handed golfer 14.

The indica 56 corresponds to numbers of a clock, with the second pivot joint 26 being the center thereof. The indicia 56 comprises the number one (1) 58, the number five (5) 60, the number six (6) 62, the number seven (7) 64, and the number eleven (11) 66.

As shown in FIG. 1, when used by the right-handed golfer 12, the aid 10 is oriented so as to allow the number one (1) 58 of the indicia 56, the number six (6) 62 of the indica 56, and the number seven (7) 64 of the indicia 56, which all lie on a same side of the aid 10, to be visible to the right-handed golfer 12. The base 16 is disposed in a direction of a hole to be shot so as to allow a forward terminal end 28 of the base 16 to point to 12 o'clock and a rearward terminal end 28 of the base 16 having the number six (6) 62 of the indicia 56 thereat to point to 6 o'clock. The one arm 18 having the number one (1) 58 of the indicia 56 thereat is pivoted to the right to 1 o'clock and the other arm 18 having the number seven (7) 64 of the indicia 56 thereat is pivoted to the left to 7 o'clock.

As shown in FIG. 2, when used by the left-handed golfer 14, the aid 10 is oriented so as to allow the number five (5) 60 of the indica 56, the number six (6) 62 of the indica 56, and the number eleven (11) 66 of the indicia 56, which all lie on a same side of the aid 10, to be visible to the left-handed golfer 14. The base 16 is again disposed in the direction of the hole to be shot 80 as to allow the forward terminal end 28 of the base 16 to again point to 12 o'clock and the rearward terminal end 28 of the base 16 having the number six (6) 62 of the indicia 56 thereat to again point to 6 o'clock. The one arm 18 having the number eleven (11) 66 of the indicia 56 thereat is pivoted to the left to 11 o'clock and the other arm 18 having the number five (5) 60 of the indicia 56 thereat is pivoted to the right to 5 o'clock.

It will be understood that each of the elements described above, or two or more together, may also find a useful application in other types of constructions differing from the types described above.

While the invention has been illustrated and described as embodied in a foldable golf swing training aid for use by a right-handed golfer and a left-handed golfer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A foldable golf swing training aid for use by a right-handed golfer and a left-handed golfer; comprising:

a) base; and b) a pair of arms;

wherein said base is for receiving a golf tee;

wherein said pair of arms are pivotally attached to said base by a pair of first pivot joints, respectively;

wherein said base comprises a pair of base members;

wherein said pair of base members of said base are pivotally attached to each other by a second pivot joint so as to allow said base to be foldable;

wherein each base member of said base has a pair of terminal ends;

wherein one terminal end of one base member of said base is pivotally attached to one terminal end of the other base member of said base by said second pivot joint;

wherein each arm has a pair of terminal ends;

wherein one terminal end of one arm is pivotally attached to the other terminal end of said one base member of said base by one first pivot joint so as to allow said one arm to be foldable;

wherein the other terminal end of said one arm is free;

wherein one terminal end of the other arm is pivotally attached to the other terminal end of the other base member of said base by the other first pivot joint so as to allow said other arm to be foldable; and wherein the other terminal end of said other arm is free.

2. The aid as defined in claim 1, wherein said pair of base members of said base are generally similar to each other;

wherein each base member of said base is flat;

wherein each base member of said base is slender;

wherein each base member of said base is elongated; and wherein each base member of said base is generally rectangular-shaped.

3. The aid as defined in claim 1, wherein said one base member of said base has a tee through bore; and wherein said tee through bore is disposed in proximity of said one terminal end of said one base member of said base.

4. The aid as defined in claim 1, wherein said pair of arms are generally similar to each other;

wherein each arm is flat;

wherein each arm is slender;

wherein each arm is elongated;

wherein each arm is generally rectangular-shaped; and wherein each arm is shorter in length than a base member of said base.

5. The aid as defined in claim 1, wherein said pair of base members of said base are collinear when in a use orientation; and wherein said pair of base members of said base overly each other when in a stored position.

6. The aid as defined in claim 5, wherein said pair of arms extend perpendicularly to said base in opposite directions to each other when in said use position; and wherein said pair of arms overly associated base members of said base when in said stored position.

7. The aid as defined in claim 1, wherein said one first pivot joint comprises said one terminal end of said one arm having a through bore therethrough;

wherein said one first pivot joint comprises said other terminal end of said one base member of said base having a through bore therethrough; and wherein said one first pivot joint comprises a pivot rivet extending through said through bore in said one terminal end of said one arm and said through bore in said other terminal end of said one base member of said base.

8. The aid as defined in claim 7, wherein said other first pivot joint comprises said one terminal end of said other arm having a through bore therethrough;

wherein said other first pivot joint comprises said other terminal end of said other base member of said base having a through bore therethrough; and wherein said other first pivot joint comprises a pivot rivet extending through said through bore in said one terminal end of said other arm and said through bore in said other terminal end of said other base member of said base.

9. The aid as defined in claim 8, wherein said second pivot joint comprises said one terminal end of said one base member of said base having a through bore therethrough;

wherein said second pivot joint comprises said one terminal end of said other base member of said base having a through bore therethrough; and wherein said second pivot joint comprises a pivot rivet extending through said through bore in said one terminal end of said one base member of said base and said through bore in said one said end of said other base member of said base.

10. The aid as defined in claim 9, wherein each said pivot rivet comprises a male portion;

wherein each said pivot rivet comprises a female portion; and wherein said female portion of each said pivot rivet snappingly receives said male portion of an associated said pivot rivet.

11. The aid as defined in claim 1, further comprising indicia; and wherein said indicia is for aiding in positioning said base and said pair of arms for use by the right-handed golfer and the left-handed golfer.

12. The aid as defined in claim 11, wherein said indica corresponds to numbers of a clock that has a center; and said second pivot joint is said center of said clock.

13. The aid as defined in claim 11, wherein one said indica comprises the number one (1);

wherein one said indica comprises the number five (5);

wherein one said indica comprises the number six (6);

wherein one said indica comprises the number seven (7); and wherein one said indica comprises the number eleven (11).

14. The aid as defined in claim 11, wherein, said aid is oriented when used by the right-handed golfer to allow said number one (1) of said indicia, said number six (6) of said indica, and said number seven (7) of said indicia, which all lie on the side of said aid, to be visible to the right-handed golfer, said base is disposed in a direction of a hole to be shot so as to allow a forward terminal end of said base to point to 12 o'clock and a rearward terminal end of said base having said number six (6) of said indicia thereat to point to 6 o'clock, said one arm having said number one (1) of said indicia thereat is pivoted to the right to 1 o'clock, and the other arm having said number seven (7) of said indicia thereat is pivoted to the left to 7 o'clock.

15. The aid as defined in claim 11, wherein, said aid is oriented when used by the left-handed golfer to allow said number five (5) of said indica, said number six (6) of said indica, and said number eleven (11) of said indicia, which all lie on the same side of said aid, to be visible to the left-handed golfer, said base is again disposed in the direction of the hole to be shot so as to allow forward terminal end of said base to again point to 12 o'clock and a rearward terminal end of said base having said number six (6) of said indicia thereat to again point to 6 o'clock, said one arm having said number eleven (11) of said indicia thereat is pivoted to the left to 11 o'clock, and said other arm having said number five (5) of said indicia thereat is pivoted to the right to 5 o'clock.

* * * * *